United States Patent [19]

Tsubakihara et al.

[11] 4,424,855

[45] Jan. 10, 1984

[54] METHOD FOR COOLING CONTINUOUS CASTING

[75] Inventors: Osamu Tsubakihara, Sakai; Kazuhide Kameyama, Kawachinagano; Hideyuki Takahama, Ohita; Kuniaki Sakai, Ohita; Akira Tsuneoka, Ohita, all of Japan

[73] Assignee: Nippon Steel Corporation, Japan

[21] Appl. No.: 281,508

[22] Filed: Jul. 8, 1981

[30] Foreign Application Priority Data

Jul. 10, 1980 [JP] Japan ..... 55-94194

[51] Int. Cl.[3] ..... B22D 11/124

[52] U.S. Cl. ..... 164/485; 164/444; 164/455

[58] Field of Search ..... 164/414, 444, 455, 485, 164/486

[56] References Cited

U.S. PATENT DOCUMENTS 3,946,792 3/1976 Thalmann ..... 164/455

4,250,951 2/1981 Mezger ..... 164/444

*Primary Examiner*—Gus T. Hampilos

*Assistant Examiner*—Peter B. Martine

*Attorney, Agent, or Firm*—Wenderoth, Lind & Ponack

[57] ABSTRACT

In the equipment for continuous casting of steel, an improved method for cooling a continuous cast slab or the like by which a hot slab can be transferred directly to a rolling step. In accordance with the improved method, the continuous cast slab is subjected to indirect cooling by means of cooling a series of guide rolls with a gas-liquid mist, or if the equipment length is limited, the slab is subjected to direct cooling by means of a gas-liquid mist cooling step, and then to the indirect cooling step in a subsequent process.

5 Claims, 12 Drawing Figures

METHOD FOR COOLING CONTINUOUS CASTING

BACKGROUND OF THE INVENTION

A. Field of the Invention

The present invention relates to a method and an equipment for cooling a continuous casting, and more specifically, to a method for cooling a hot continuous cast steel slab or bloom and equipment for carrying out the same.

B. Description of the Prior Art

Quite recently, with the enhancement of both inner and surface qualities of continuous cast slab, bloom and billet, together with the increase in energy-saving, "direct rolling" in which a hot slab or the like is transferred directly to a rolling step has gained acceptance.

In the conventional method a slab or the like is continuously cast, cut to size, subjected to hot scarfing, cooled, treated for partial hand scarfing to remove surface defect, reheated in a heating furnace, and finally passed through a roughing mill and a finish rolling mill. However, heat loss at the intermediate stages is so great that a considerable amount of heat energy is required for the reheating operation. Therefore a method for eliminating the above reheating furnace was desired. This led to "direct rolling" which was made feasible by improvements over the inner and surface qualities of the continuous casting slab and the fact that treatment by an operator had been made unnecessary.

It is of primary importance that a continuous casting slab and the like should be maintained at as high a temperature as possible, and further, that the whole slab should also be maintained at a uniform temperature, and then, should be delivered to the rolling step in good condition in order to carry out the direct rolling process (referred to "CC-DR process" hereinafter) or a direct charging into a heating furnace and rolling process (referred to "CC-HDC process" hereinafter).

However, the temperature of the continuous casting slab is gradually reduced in the course of transport, and particularly, the temperature of both side edges of the slab falls considerably lower than that of the center of the slab so that the temperature of the slab is inevitably unsuitable for rolling.

One way to overcome the above problem might be to provide an induction heating furnace and a gas heating apparatus at an intermediate stage between the continuous casting equipment and the rolling mill as a means for heating chiefly the side edges of the slab to make the temperature of all portions of the slab as uniform as possible by raising the temperature of the side edges in order to carry out rolling in a smooth manner. However, the above means is not desirable from an energy-saving point of view, and further, it is disadvantageous economically because the equipment cost is high and the electric power required is considerable.

A method for attaining a sound continuous casting slab in which a mist of air-liquid mixture consisting of warm water and a cold medium is sprayed onto the slab to carry out a slow and delayed cooling has been proposed. As compared with water cooling, gas-liquid mist cooling is able to cause a volume of water 200–300 times as large as that of water only to impinge on the slab since the mixed mist splashes three-dimensionally between narrow rolls of the continuous casting machine to achieve uniform sprinkling of the cooling mist so that the cooling ability is exceedingly high.

On the other hand, since the orifice of the spray nozzle used for the gas-liquid mist makes a mist of cold water and air upstream of the spray nozzle, a simple form of slit will suffice for the purpose. Therefore, clogging of the nozzle is no problem at all because the slit can be made to have a larger opening than that of the conventional nozzle by 50–60 times.

SUMMARY OF THE INVENTION

With a view to overcoming the above-mentioned problem, we inventors have conducted research toward maintaining the temperature of the trailing end of a continuous casting slab as high as possible so as to reduce the temperature deflection or deviation at both side edges of the slab as little as possible without recourse to the application of other energy, and further with no additional investment burden.

As a result, we have completed the present invention in which a continuous casting slab is subjected to indirect cooling via a series of guide rolls the surfaces of which are cooled by an air-liquid mist system, and the guide rolls are arranged as guides in a region where the slab following a mold is withdrawn.

Accordingly, it is an object of the present invention to provide a method for cooling a continuous casting slab in which the slab is maintained at as high a temperature as possible so as to complete solidification thereof, whereby it is directly transported to a rolling step to be rolled thereby.

It is another object of the invention to provide a method for cooling a continuous casting slab to obtain a defect-free hot slab which can be transported directly to a rolling step to be rolled thereby.

It is still an additional object of the invention to provide cooling equipment for cooling a continuous casting slab in order to attain the above aim.

BRIEF DESCRIPTION OF THE DRAWINGS

Other and further objects of the invention will be better understood from the following description of the invention with reference to the accompanying drawings, in which.

DETAILED DESCRIPTION OF THE INVENTION

The present invention will be described with reference to the drawings hereinbelow.

Figure 1:
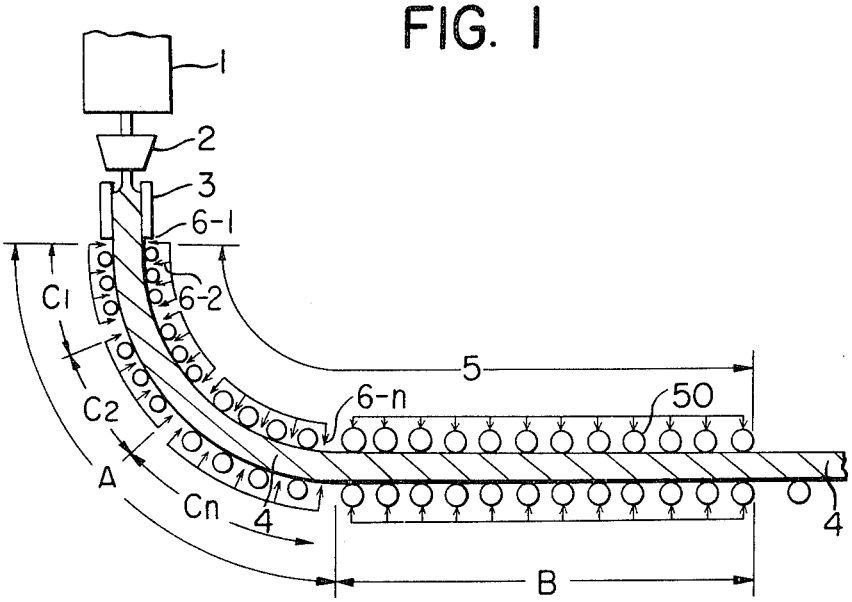
FIG. 1 is a schematic sectional view showing the fundamental construction of equipment for the continuous casting of steel in accordance with the present invention.

FIG. 1 is a view showing the fundamental construction of the invention, and also a sectional view of a standard continuous casting machine to which an embodiment of the invention is added.

In FIG. 1, a ladle 1, a tundish 2, and a mold 3 are depicted. Molten steel stored in the ladle 1 is poured into the mold 3 via the tundish 2, and the casting 4 is subjected to primary cooling (the casting is indirectly cooled via the mold by a cooling medium) to form the casting 4. Subsequently, in this invention the casting 4 is continuously withdrawn from the mold 3 by a series of withdrawal guide rolls 5, and the casting 4 is further cooled while it is transported through a secondary cooling zone A (the casting is directly cooled by the cooling medium) and a lower stream zone following the secondary cooling zone A, namely, a horizontal guide region B.

The solidified shell of the surface of the casting grows, and the casting 4 is solidified to its core by the time it reaches the trailing end of the series of withdrawal guide rolls 5.

We have conducted research for the purpose of elevating the temperature of the casting at the trailing end thereof as high as possible, and as a result we have found out that the above-mentioned withdrawal guide rolls 5 have an important influence on the cooling of the casting.

On the other hand, in the secondary cooling zone, the casting 4, in general withdrawn from the mold 3 while it is being solidified is further directly cooled by cooling water, and it is subjected to controlled cooling so as to be completely solidified by the time it reaches a casting cutter (not shown in the drawing).

The prior art technique has been heretofore directed to developmental work wherein the casting 4 is made to reach complete solidification in the preceeding secondary cooling zone A, and further, it is cooled to room temperature on the assumption that a subsequent treatment is required for repairing local defects thereon. However, since the method of prior art was directed to the supercooling of the casting in the secondary cooling zone A, the cooling fluid stream for the casting was controlled so as to prevent the fluid stream from flowing in the longitudinal direction of the casting by each of the group of rolls 5 located in the secondary cooling zone A so as to cause the stream to flow along both sides downwardly. The side edge of the casting releases much heat, and copious amounts of water flow downward, hence the temperature of the casting is considerably reduced with the result that many spots of varying temperature were observed to be distributed in the sectional direction of width.

Figure 2:
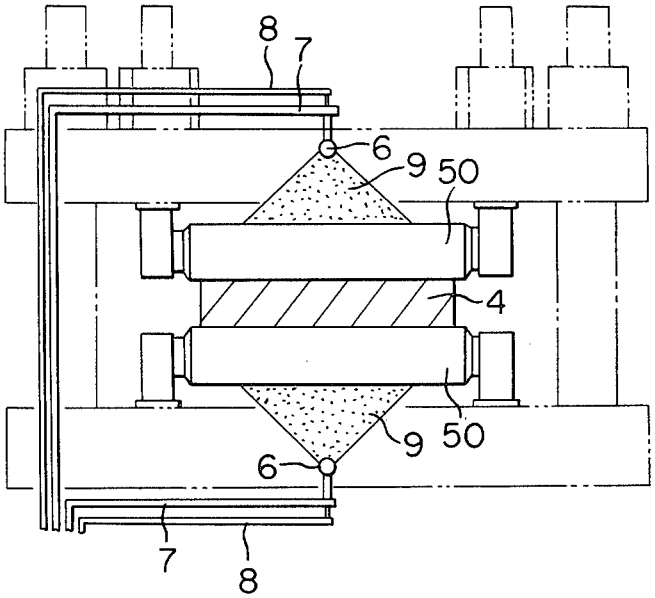
FIG. 2 is a sectional view depicting how a guide roll is cooled by an air-water system.

In accordance with the present invention, however, the solidification of the casting is not completed until the casting cutter, and for the purpose of maintaining the temperature of the casting as high as possible, we have now realized an advance wherein we utilize the group of withdrawal guide rolls 5 as a whole for cooling the casting. In the continuous casting machine, it is effective to subject the casting to indirect cooling by spraying an air-water fluid onto some or all of the group of guide rolls 5 which withdraw and guide the casting to cool some or all of them (referred to "roll outside cooling system" hereinafter). The construction for the roll outside cooling system comprises, for instance, as shown in FIG. 2, an air-water spray nozzle 6 provided immediately above and below a guide-roll 50 with the air-water spray nozzle 6 being connected with an air feed pipe 7 and a cooling water feed pipe 8.

In the roll outside cooling system, the casting is indirectly cooled via the guide-rolls 50 in order to reduce the temperature of the casting 4 very slowly, and further, decrease temperature deviation in the sectional direction of slab width as much as possible. An air-water mist cooling process wherein a cooling medium 9 consisting of the mixture of cooling water and air is sprayed is adopted to cool only the guide-rolls 50 in a uniform manner in the width direction.

It is preferred that the above cooling medium should be sprayed onto the surface of the desired guide-rolls uniformly and the cooling medium adhering to the surface of the guide-rolls be evaporated by the time the guide-roll 5 revolves and comes in touch with the casting 4.

Figure 3:
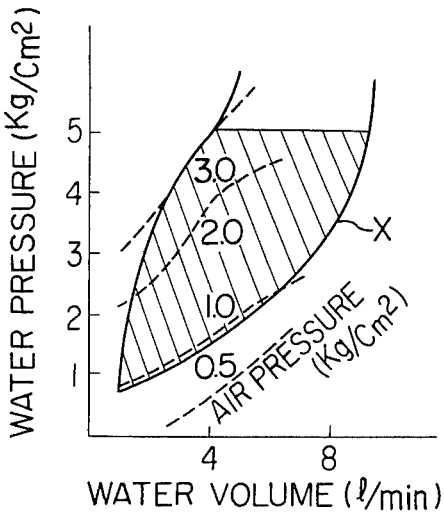
FIG. 3 shows the results of experiments regarding the spraying of cooling water where water pressure, water volume and air pressure are varied.
Figure 4:
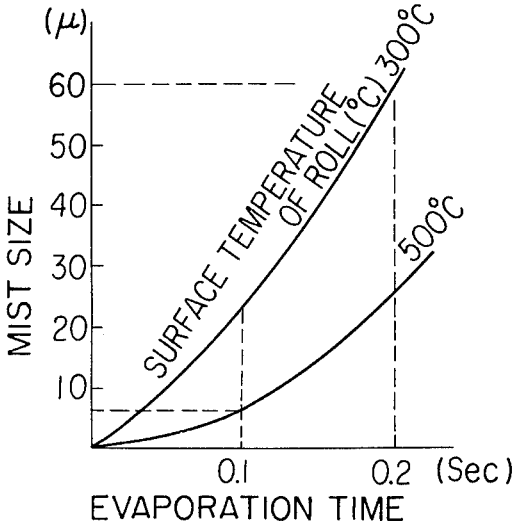
FIG. 4 shows the results of experiments in connection with the relation between particle size of cooling water, surface temperature of roll, and evaporation time.

FIGS. 3–4 show the results of various experiments conducted in order to perform the above roll outside cooling system. FIG. 3 shows the results of the experiment in which the water pressure, water volume, and air pressure were independently varied by utilizing an air-water spray nozzle 6 of an internal mixture type as shown in FIGS. 5–6 to investigate the state of spraying of the cooling water while FIG. 4 illustrates the results of an experiment in which the relation between particle size of cooling water, temperature of outside surface of roll, and evaporation time was investigated.

Figure 5:
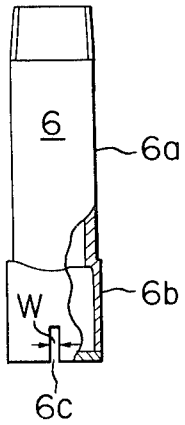
FIGS. 5–6 are structural views depicting embodiments of an air-water spray nozzle.
Figure 6:
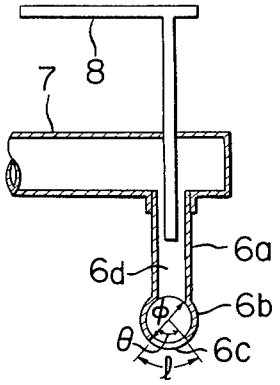

The air-water spray nozzle 6 in FIGS. 5–6 comprises a tubular body **6*a* and a cylindrical body 6*b* secured to the end of the tubular body 6*a* to form a mixing member 6*d*, and a slit-like nozzle 6*c* opens in the cylindrical body 6*b*. Air and cooling water are mixed together in the mixing member 6*d*, and then a mixed mist is sprayed from the nozzle 6*c* in accordance with the air-water spray nozzle 6** of an embodiment of the invention.

A shaded portion X of the diagram of the experimental results in FIG. 3 shows the range wherein the particle size of cooling water ejected from the air-water spray nozzle 6 forms a very fine particle less than 60 μm, exhibits a uniform spray state, and further, the uniform spray state can be maintained in a stable manner. Therefore, if we beforehand obtain the relationship shown in FIG. 3 in accordance with the construction and size of the air-water spray nozzle 6, it is seen that the optimum control regarding the water pressure and air pressure required for carrying out effective air-water mist cooling can be easily obtained in compliance with the variation of cooling water volume which is determined by the cooling capacity required.

As it is clearly seen from FIG. 4, it has been confirmed that if the particle size of cooling water is less than 60 μm, the cooling water is almost completely evaporated within 0.2 seconds after it comes in contact with the roll surface. Hence direct contact of cooling water with the casting 4 can be prevented. Accordingly, in accordance with the present invention, the air-water mist cooling of the guide-roll 50 is made feasible by determining the structure and size of the air-water spray nozzle 6 on the basis of the spray width and the required cooling capacity described hereinafter and by controlling the water volume, water pressure, and air pressure in a pertinent manner in compliance with the set conditions.

According to the inventors' experimental results, the range wherein the air-water mist cooling capacity of the guide roll 50 increases to the utmost, namely, the central portion of the guide roll 50 (referred to "cooling range" hereinafter) is the one where it is adjacent to the central portion corresponding to 60–80% of the width of the casting 4, and it is seen that the above range is excellent in exhibiting the above advantage. Therefore it is preferred that an opening angle $\theta$ of a nozzle 6*c* of the air-water spray nozzle 6 should be determined as shown in FIG. 6 so as to be able to spray 9 (FIG. 2) a cooling medium fluid uniformly onto the cooling region, and further, the number of the air-water spray nozzles 6 should also be determined.

As described above, in the present invention, the reduction of the temperature of the casting 4 occurs very little in the course of transport through the group of guide rolls 5 and the temperature reduction of the casting 4 is lowered to minimum because the roll outside cooling system is applied at the lower stream of the secondary cooling zone. According to the present invention the roll outside cooling system in the continuous casting machine makes the secondary cooling zone useless or short, or reductive at the cooling capacity. Furthermore, in the roll outside cooling system, the temperature of the casting at its trailing end of the group of guide rolls 5 can be maintained very high, and besides, the overall uniform temperature can be also kept high by incresing the cooling capacity of the central part of the casting 4.

Figure 7:
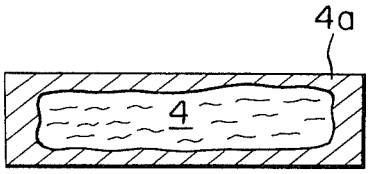
FIG. 7 is a sectional view depicting a continuous casting slab in general.

As shown in FIG. 7, the casting 4 is transported through the group of guide rolls 5, and it is cooled while a solidified shell 4*a* is being grown. In accordance with the invention, when the length of the continuous casting machine is limited, it is preferred that as the cooling pattern in which the solidified shell of the casting 4 grows from its surface to a specified thickness described hereinafter, the group of guide rolls 5 comprise a secondary cooling zone A wherein the casting 4 is directly and forcibly cooled by a cooling medium and a roll outside cooling zone B wherein only the guide rolls 50 are cooled by air-water mist, and the zone B is located in the lower stream following the secondary cooling zone A.

The inventors have confirmed that if the solidified shell 4*a* grows to about 40–50% of the casting section at the end of the secondary cooling zone A, although the casting may be transported while it is being indirectly cooled in accordance with the invention, no trouble, such as break-out or crack occurrence, etc. takes place in the course of transport so that efficient production can be performed.

Figure 8:
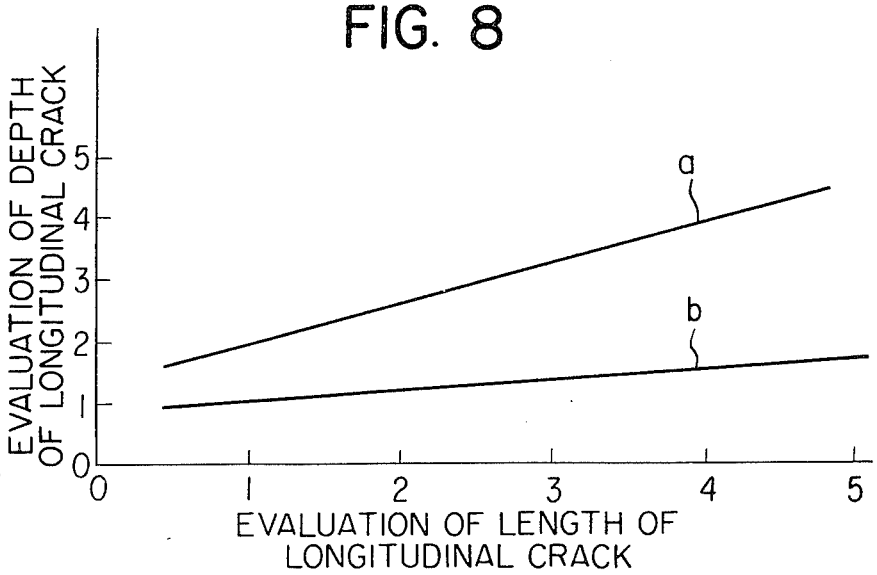
FIG. 8 is a graph indicating an evaluation of the length of a longitudinal crack and an evaluation of the depth of a longitudinal crack in connection with water cooling and air-water mist cooling, respectively.

In general, in the curved type continuous casting plant, straightening of the casting is completed at the end of a curved guide region consisting of the secondary cooling zone (referred to "final straightening point" hereinafter). The casting finishes its solidification after the final straightening point in the curved continuous casting machine. A comparison of results of evaluation between secondary cooling by means of cooling water only and secondary cooling by air-water in the secondary cooling zone A in connection with the length and width of a longitudinal crack of the casting obtained from the above machine is shown in FIG. 8, in which a shows the secondary cooling by cooling water only while b indicates the secondary cooling by air-water (referred to "air-water mist cooling" hereinafter). In FIG. 8, it is clear that the depth of the crack is reduced by half. The results of an investigation on the history of occurrence of a longitudinal crack of a casting by water cooling before and after the straightening point are illustrated in FIG. 9 as curve A.

Figure 9:
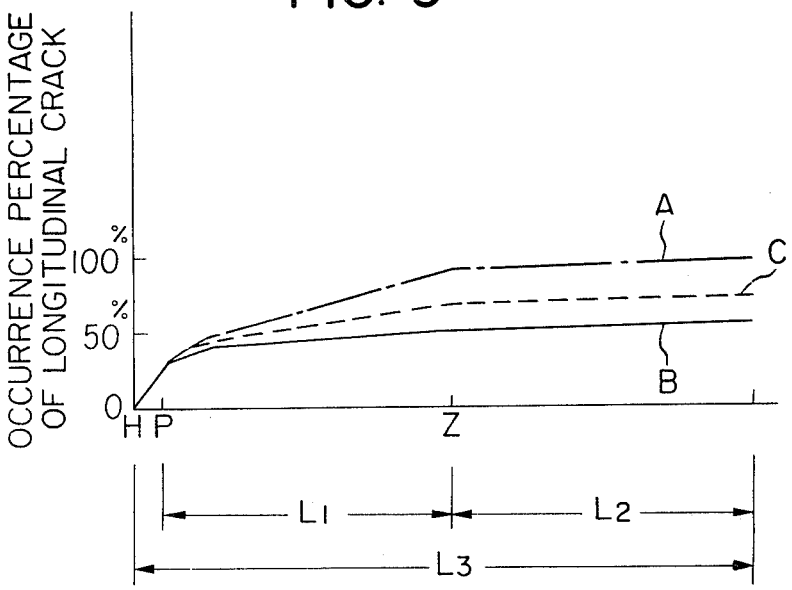
FIG. 9 is a graph showing the incidence ratio of longitudinal cracks along the length of a continuous casting machine.

According to the curve A obtained from water cooling shown in FIG. 9, it is clear that most longitudinal cracks occur before the final straightening point of the length of the continuous casting machine, and there is little variation in the frequency of occurrence after the straightening point. In FIG. 9, $L_1$ refers to a curved guide region, $L_2$ to a horizontal guide region, $L_3$ to the length of a continuous casting machine, Z to the final straightening point, H to a mold meniscus, and P to a mold outlet. Hence in this invention, an adaptable zone of air-water mist cooling is provided on part or the whole of the curved guide region from a guide roll immediately below the mold to just in front of the final straightening point.

Figure 10:
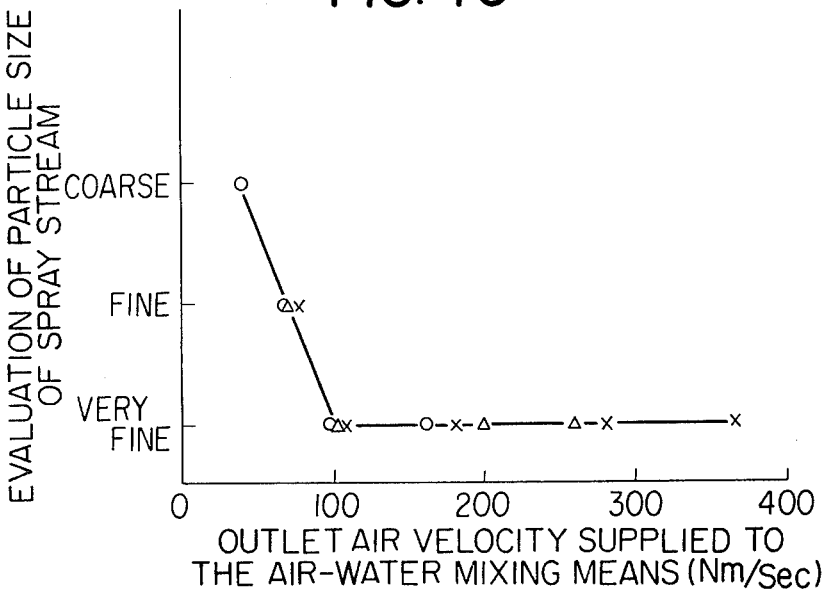
FIG. 10 is a graph indicating the relation between outlet air velocity at the slit-like nozzle installed at the head of a spray nozzle and evaluation of particle size of a spray stream.

According to the inventors' research, the mist property in air-water mist cooling varies remarkably depening on the outlet air velocity at the slit-like nozzle installed at the head of the spray nozzle, and the correlation therefor is depicted in FIG. 10. It is clear in FIG. 10 that in order to obtain air cooling with fine, uniform particles of mist, the mist of uniform, very fine particle size can be obtained in a stable manner by making the flow velocity of discharged air at the slit-like nozzle more than 100 Nm/sec. and, delivering it to the mixing member in front of the spray nozzle. If less than 100 Nm/sec., the particle size of mist grows coarse. In FIG. 10, O refers to 3 l/minute, Δ to 5 l/min. and X to 7 l/min. according to actual measurement.

An embodiment of the cooling means of this invention is described with reference to FIG. 11.

As shown hereinbefore in FIGS. 5–6, the air-water spray nozzle 6 (referred to "spray nozzle" hereinafter) comprising an outlet 6*c* having a width W of 2–3 mm, a body length l of 10–30 mm and two pressure loaded chambers 6*b* having the same shape and the same volume at both sides of the forward end with a diameter $\phi$ of 12–14 mm is used, and a plurality of spray nozzles 6 are provided on each guide roll 50 disposed above and below the zone adapted for the air-water mist cooling of the casting predetermined in the width direction.

A zone adapted for effecting air-water mist cooling onto the casting is previously divided into a plurality of cooling zones $C_1$–$C_n$, and two main pipes 41 and 21 (an upper main pipe 21 only is shown) branch out from each feed pipe to supply an air-liquid medium to each cooling zone, respectively. One main pipe 21 is installed above the upper roll while the other main pipe is installed below the lower roll.

Figure 11:
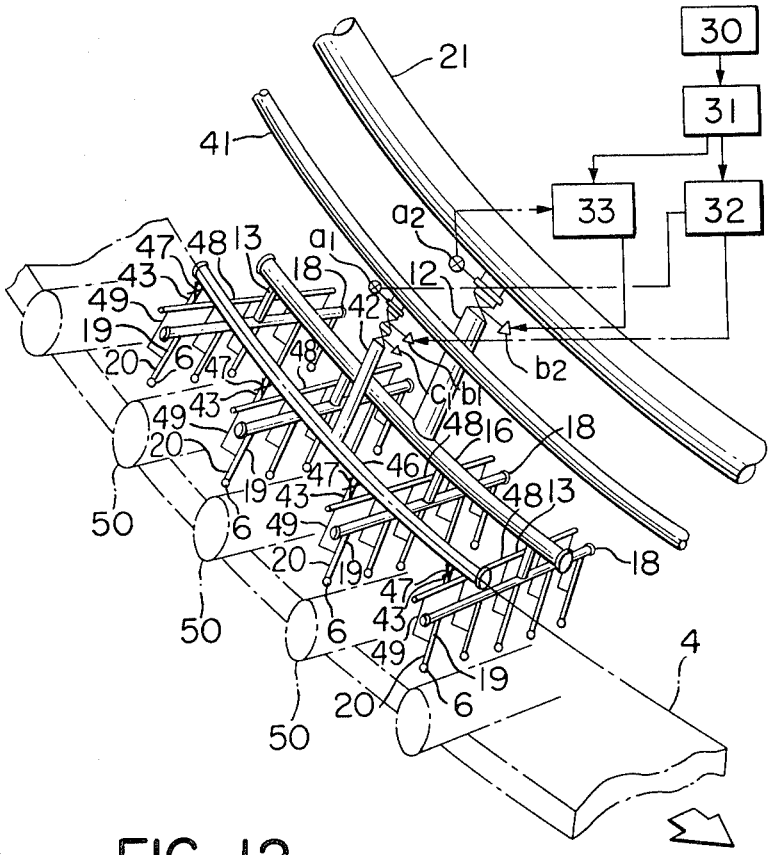
FIG. 11 is a perspective explanatory view indicating the essential part of an embodiment in accordance with the invention.

The above air-liquid cooling medium system for each zone $C_1$–$C_n$ is illustrated in FIG. 11 wherein only the upper roll of the zone $C_2$ is represented. In FIG. 11, a liquid cold medium system for each spray nozzle 6 comprises a cooling water control main pipe 42 connected to a cooling water main pipe 41 via a flowmeter $a_1$, a flow control valve $b_1$ and a check valve $c_1$, a cooling water intermediate header pipe 46, a branched pipe 43 via a throttle member 47, a cooling water header pipe 48 in front of the nozzle, and a cooling water feed terminal pipe 49, all of the pipes being connected together. The cooling water feed terminal pipe 49 is connected to a mixing pipe 20 for cooling water and air.

On the other hand, the air medium system comprises a compressed air main pipe 21 connected to a compressed air control main pipe 12 via a compressed air flowmeter $a_2$ and a compressed air flow control valve $b_2$, a compressed air intermediate header pipe 16, a branched pipe 13, a header 18 in front of a compressed air nozzle, and a compressed air feed terminal pipe 19, all of the pipes being connected together. The compressed air feed terminal pipe 19 is integrally connected to the above mixing pipe 20 to the forward end of which is connected to the above spray nozzle 6.

Figure 12:
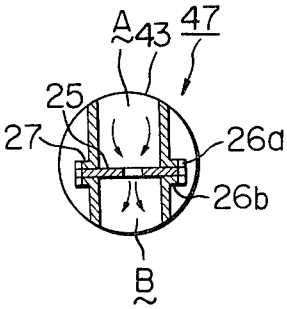
FIG. 12 is a sectional detailed view explaining an embodiment of a squeezer shown in FIG. 11.

An embodiment of a squeezer or throttle member 47 of this invention is illustrated in FIG. 12. The squeezer 47 is formed by providing a pair of flanges 26*a* and 26*b* intermediately of a branched pipe 43, disposing a partition plate 25 therebetween to form a throttle for controlling a cooling water head difference, and securing them with a bolt 27.

Although the amount of water from the cooling water control main pipe 42 is reduced to lower the back pressure of the spray nozzle, it is possible to obtain a high back pressure sufficient to absorb a pressure loss due to a head difference upstream of a partition plate i.e. upstream A of the partition plate by providing the partition plate 25 at each branched pipe 43, and it is also possible to feed cooling water of a uniform flow amount to the cooling water head pipe 48 in front of the nozzle connected to each downstream side B. Therefore the air and water are mixed together at each spray nozzle under the same low backpressure requirement to improve the mist characteristics of the spray nozzle with the result that the surface of the casting passing through the corresponding cooling zone can be uniformly cooled and occurrence of surface defects on the casting can be surely prevented. Thus the above cooling process should have a great practical advantage.

In the foregoing, the squeezer or throttle member has been explained with reference to the above embodiment comprising a partition plate provided at each branch pipe 47 between the cooling water intermediate header 46 and the cooler water header 48 in front of the nozzle, but, needless to say, the present invention will not be limited thereby. Though it is not shown in the drawing, in case one side of the cooling water header pipe in front of each nozzle is directly connected with a certain distance in the longitudinal direction of the cooling water intermediate header pipe, a functional effect the same as that of the foregoing can be attained by installing the squeezer or throttle member at the terminal end of liquid introduction of the cooling water header pipe in front of the nozzle, namely, in the vicinity of a connecting portion with the cooling water intermediate header pipe.

As another embodiment of the squeezer or throttle member, any mechanism, such as an orifice pipe which can give a pressure difference to the water before and behind, will do for the purpose.

A control apparatus in accordance with an embodiment of this invention is depicted in FIG. 11. In the control apparatus, the cooling pattern of the respective cooling zones ($C_1$–$C_n$) and the casting speeds determined previously by the kind of steel of the casting are inputted into a programming unit 30, and the amount of compressed air current in respective compressed air control main pipe 12 should be calculated by an operating unit so as to obtain more than 100 Nm/sec. of outlet air velocity at the slit-like nozzle installed at the head of a spray nozzle.

Further, the amount of cooling water flow from the respective cooling water control main pipes 42 is calculated and the calculated amount of cooling water is introduced into a control water controller 32 and a compressed air controller 33 of control main pipes (42, 12) of respective cooling zones, respectively, to control the cooling water control valve $b_1$ and the air control valve $b_2$. Hence the casting 4 is sprayed by a mixed mist of air and water having a desired flow velocity via the spray nozzle 6.

And in the manufacture of a mixed mist of air and water in the present invention, an outlet air velocity of more than 100 Nm/sec. can be obtained by setting the amount of air flow at a certain value, and by controlling the cool water only for the purpose of intensifying or weakening the coolability of the casting, hence the control apparatus can be much more simplified. Besides, at a low water spray ratio, such as, 0.3 l per kilogram of casting, a mist of uniform very fine particles can be produced in a stable manner by the air-water mixture due to the outlet air velocity of more than 100 Nm/sec. until the final straightening point where the occurrence percentage of longitudinal cracks is the highest. By spraying the above mist uniformly over the surface of the casting via the spray nozzle 6, as clearly shown in a curve B of FIG. 9, it is seen that the occurrence percentage of longitudinal cracks is remarkably reduced as compared with a curve A representing cooling by water only and a curve C representing cooling by less than 100 Nm/sec., and in this respect the industrial advantage is exceedingly great. And at the very end of the secondary cooling zone, its length is so determined that the abovementioned solidified shell will grow, and the amount of cooling fluid is also determined there depending on a cooling capacity required.

As shown in FIG. 7, the solidified shell 4*a* will not grow uniformly in the section direction of width, and the growth speed thereof at both sides is considerably faster than that of the middle portion. Therefore in the roll outside cooling system, the air-water mist cooling capacity of the middle portion of the guide roll 50 is so increased that the heat load of the roll is effectively removed, and it is arranged that heat is restored to the side edge of the casting while the middle of the casting where the cooling speed is slow is being cooled.

In other words, a still unsolidified portion remains in the middle of the casting 4 transported from the secondary cooling zone to the roll outside cooling zone, and the temperature of the middle is exceedingly high while both side edge portions are almost solidified. Thus, in the present invention, the air-water mist cooling capacity in connection with the guide roll adjacent to the high temperature middle portion of the casting (namely, the middle portion of the guide roll 50 of this invention) is increased.

With the increase of air-water mist cooling capacity of the middle portion of the guide roll 50, the whole casting 4 is lowered in temperature at a gentle gradient, and finally its core is completely solidified by the time it reaches the end of the roll outside cooling zone B, namely, by the time it reaches the casting cutter. On the other hand, however, both side portions of the casting 4 are cooled little as far as the roll outside cool zone B, and in the direction of recovering heat, hence the difference of temperature between the final end of the roll outside cooling zone B can be considerably reduced.

Further, the heat conductance resulting from the contact of the hot casting can be immediately reduced by cooling the guide roll 50 with air-water, so that the temperature rise of the guide roll itself can be efficiently prevented with the result that the endurance life of the guide roll 50 is exceedingly enhanced.

The nearer the casting 4 is to the secondary cooling zone, the higher the temperature of the casting 4 in the roll outside cooling zone, and the thickness of the solidified shell which has grown at both sides is small. It is preferred and effective that the cooling capacity of the guide roll 50 increases and widens its range in the roll outside cooling zone near to the secondary cooling zone while the range of an increase of the cooling capacity is gradually narrowed according as the casting becomes distant from the secondary cooling zone.

Moreover, it can be arranged that the water amount, water pressure, and air pressure, etc. for the air-water mist cooling process can be automatically controlled from the standpoint of the necessary cooling capacity, as determined by the thermometric values obtained from the temperature measurement of the overall temperature of the casting 4 at the final end of the secondary cooling zone or at the roll outside cooling zone B, the distribution of the temperature in the width direction, and the temperature of the outside surface of the guide roll 50, etc. continuously and intermittently together with the quality, size and withdrawal speed of the casting 4. Any suitable design therefor may be made.

EXAMPLE 1

A casting of 1000 mm wide and 250 mm thick was continuously cast with a withdrawal speed 1.6 m/min.

In accordance with the cooling method of this invention, the reduction of temperature at the side edge portion of the casting (the average temperature of a section 40 mm distant from the side of the casting) was about 10° C. as compared with the reduction of the temperature of the casting 200° C. to 40° C. in accordance with the conventional cooling method.

In consequence, in carrying out the CC-DR process, the induction heating or gas heating of the side of the casting was no longer required so that the superiority of this invention was confirmed.

EXAMPLE 2

1. Profile of continuous casting machine
   (1) Type: Bending type continuous casting machine of a single circular arc type
   (2) Bending guide region: radius of curvature 10.5 m, length 16.5 m
   (3) Horizontal guide region: length 22.5 m
2. Requirements for the continuous casting
   (1) Kind of Steel: Al-Si killed steel
   (2) Temperature of Molten Steel Poured Into Mold: 1535° C.
   (3) Cast Casting Size: 1900 mm wide×280 mm thick
   (4) Casting Speed: 1.2 m/min.
3. Cooling Requirement in the Casting Withdrawal and Guide Region
   (1) Curved guide Region: Direct Cooling by Air-water mist Spray
   (2) Surface Temperature of Casting at the Outlet of Curved Guide Region: 950° C.
   (3) Average Temperature of Casting at the Outlet of Curved Guide Region: 1440° C.
   (4) Horizontal Guide Region: Indirect Cooling via Guide Roll Cooled by Air-water mist at the outside
   (5) Surface Temperature of Casting at the Outlet of Horizontal Guide Region: 960° C.
   (6) Average Temperature of Casting at the Outlet of Horizontal Guide Region: 1190° C.
4. Quality of Casting
   (1) The number of longitudinal cracks on the casting surface was reduced by half as compared with the sprinkle cooling of the curved guide region by water only.

We claim:

1. In a method for cooling a continuous casting while said continuous casting is being guided along a withdrawal path downstream of a continuous casting mold, the improvement comprising providing a cooling zone in a horizontal guide region downstream of a curved guide region of said withdrawal path, and spraying a gas-liquid mist onto a plurality of guide rolls in the horizontal guide region such that the gas-liquid mist adhering to the guide rolls evaporates prior to contacting said casting, to indirectly cool the casting so as to complete inner solidification of said casting at a high temperature.

2. The method as claimed in claim 1 wherein said casting is directly cooled by spraying a gas-liquid mist between a plurality of guide rolls in a curved guide region.

3. The method as claimed in claim 1 wherein the gas-liquid mist cooling capacity in the central portion of said plurality of said guide rolls is increased to more than that of both ends so as to cool said casting indirectly.

4. The method as claimed in claim 1, in which a gas-liquid mist having more than 100 Nm/sec. of outlet flow velocity of an air cooling medium at a slit-like nozzle installed at the head of a spray nozzle is sprayed among said guide rolls.

5. The method as claimed in claim 1 in which a gas-liquid mist whose particle size of the liquid cooling medium is less than 60 μm is sprayed onto the surfaces of guide rolls.

* * * * *